US005616108A

United States Patent [19]

Hayden

[11] Patent Number: 5,616,108

[45] Date of Patent: Apr. 1, 1997

[54] DUMBBELL SUPPORT ATTACHMENT FOR BARBELL CROSS BAR

[76] Inventor: Richard C. Hayden, 1576 Heathwood Dr., Decatur, Ga. 30033

[21] Appl. No.: 385,773

[22] Filed: Feb. 9, 1995

Related U.S. Application Data

[63] Continuation-in-part of Ser. No. 620,702, Dec. 3, 1990, Pat. No. 5,411,459.

[51] Int. Cl.[6] ..... A63B 13/00

[52] U.S. Cl. ..... 482/104; 482/108

[58] Field of Search ..... 248/214, 300; 482/104, 148, 108

[56] References Cited

U.S. PATENT DOCUMENTS

| | | | |
|---|---|---|---|
| D. 176,703 | 1/1956 | Snively | 248/300 |
| D. 184,508 | 3/1959 | Burt | 248/300 |
| 1,541,128 | 6/1925 | Ennis | 248/300 |
| 2,612,273 | 9/1952 | Smith | 248/214 |
| 4,773,642 | 9/1988 | Cruz | 482/104 |
| 5,411,459 | 5/1995 | Hayden | 482/104 |

*Primary Examiner*—Jerome Donnelly
*Attorney, Agent, or Firm*—Harry I. Leon; Vivian L. Steadman

[57] ABSTRACT

A dumbbell support attachment for holding a dumbbell from a barbell cross bar so that the dumbbell can be used with a typical weight lifting bench. Suspended from the barbell cross bar when it is supported, in the usual manner, above the weight lifting bench, the attachment provides the user with a convenient support on which to mount a dumbbell at the beginning and end of an exercise routine. The attachment includes a segmented section and an elongated hook, which together form an integral unit preferably fabricated from steel or the like. Adapted for mounting over the cross bar, the hook opens downwardly and has an inner surface disposed generally along a semicircular arc of slightly larger diameter than that of the crossbar. The segmented section, on the other hand, opens upwardly and has a curved inner surface with a radius of curvature which is larger than that of the outer periphery of the heaviest dumbbell weights to be used. So that the user, as he lies on the weight bench, can grab the dumbbell and lift it from its resting position within the segmented section, the bottom portion thereof defines two cutouts. The center of gravity of the attachment and one or more dumbbells supported therein is located directly below the barbell cross bar. Tabs attached to each end of the segmented section are provided to stabilize the attachment, preventing its rotation about the cross bar, whenever one or both of the dumbbells is taken out of or placed in the attachment.

5 Claims, 3 Drawing Sheets

DUMBBELL SUPPORT ATTACHMENT FOR BARBELL CROSS BAR

This application is a continuation-in-part of Ser. No. 07/620,702 filed Dec. 3, 1990, now U.S. Pat. No. 5,411,459.

BACKGROUND OF THE INVENTION

This invention relates in general to exercise equipment and in particular to dumbbells for use while exercising. In the applicant's previous teachings, there is disclosed a dumbbell rack attachment having a saddle for holding the dumbbell, the saddle being mounted on one of two vertically-disposed barbell support columns. The present invention, by contrast, does not require any modification of either of these barbell support columns but rather is mounted upon the horizontally-disposed cross bar of the barbell.

In the prior art, Segrist, U.S. Pat. No. 4,666,150, which issued May 19, 1987, discloses a dumbbell support rack. Segrist's rack, however, requires two support columns for each dumbbell.

SUMMARY OF THE INVENTION

The object of the present invention is to provide a dumbbell support which is convenient to use and which can be safely utilized with a typical weight lifting bench unmodified with respect to its weight support columns or otherwise, thereby accommodating the majority of body building weight lifters who use both barbells and dumbbells during their exercise routines.

In accordance with the present invention, there is provided an attachment which can be hung from the horizontally-disposed crossbar of a barbell supported by the columns of a standard weight-lifting bench for supporting at least one dumbbell.

DETAILED DESCRIPTION OF THE PREFERRED EMBODIMENT

Figure 1:
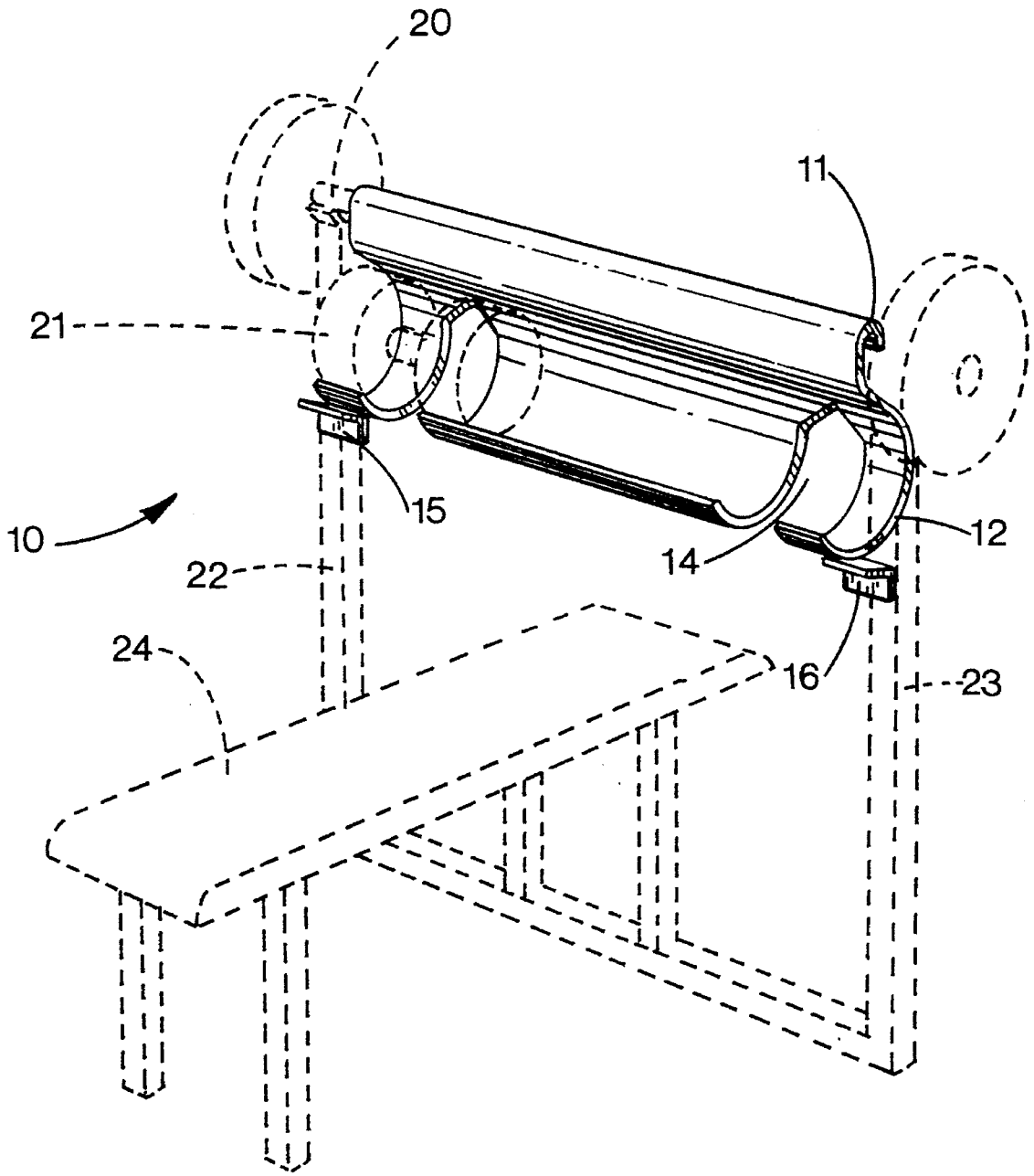
FIG. 1 is a perspective view, of the dumbbell support attachment according to the present invention, the attachment being shown hanging from the cross bar of a barbell which is supported by the columns of a weight lifting bench, the barbell, dumbbell, and bench shown in dashed lines for illustrative purposes only.

Referring to the drawing, an apparatus indicated generally by the reference number 10 is provided for supporting up to two dumbbells 21 from the cross bar 20 of a horizontally mounted barbell. The apparatus 10 comprises a hook 11 and a dumbbell holder 12 formed so that the center of gravity thereof, whether or not the dumbbell 21 is resting in the holder, is disposed directly below the centerline of the cross bar 20 when the apparatus is suspended therefrom. Both the hook 11 and holder 12 can be fabricated from a single piece of metal or the like that is either rolled or molded.

Figure 3:
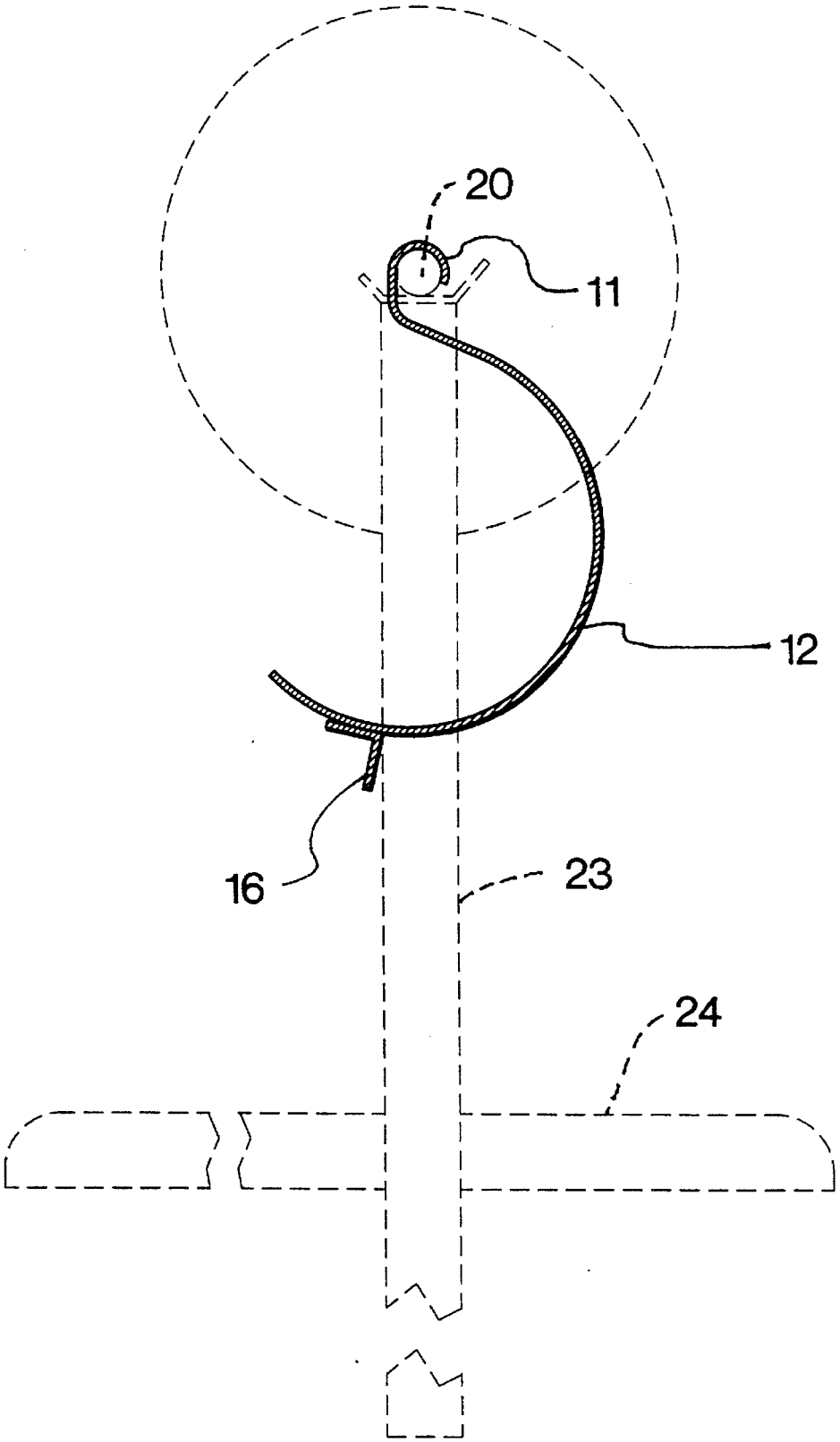
FIG. 3 is a cross sectional view taken on line 3—3 of FIG. 2.

When the attachment 10 is viewed from the side in elevation or in cross-section, the attachment defines a structure having the appearance of a "J" with the hook 11 on top (FIG. 3). The hook 11, in transverse cross-section, is of generally semicircular shape, such cross-sections having, by way of example, a radius of curvature of about a ⅝ inch. Transverse cross-sections of the holder 12, located within the curved portion of the "J" structure, on the other hand, have a radius of curvature of about 5 inches.

Figure 2:
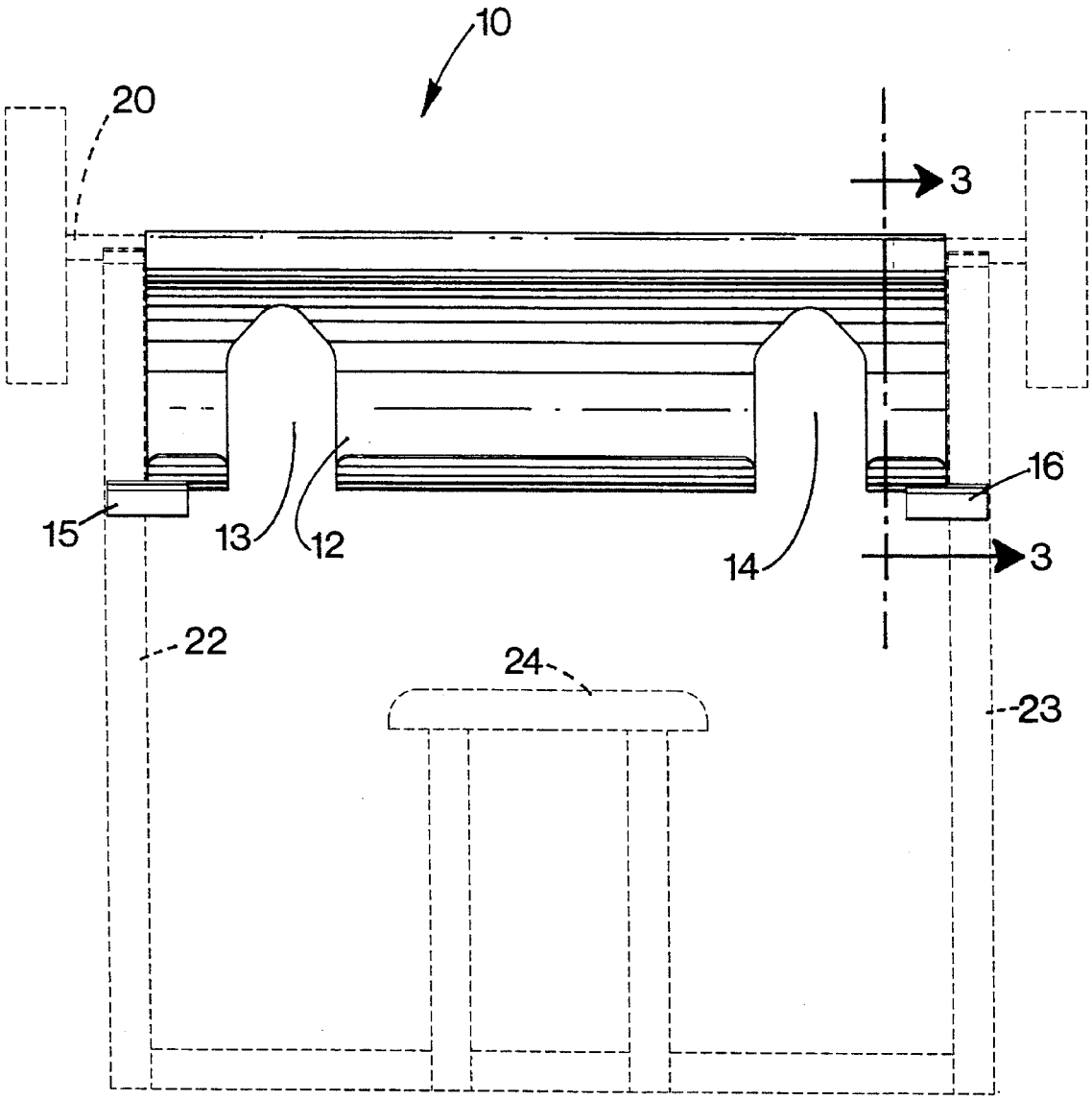
FIG. 2 is an elevational view of the attachment according to FIG. 1.

When the apparatus 10 is viewed in elevation from the foot of the bench 24, the holder 12 is seen to be an elongated open tube which measures, by way of example, about 40 inches in length (FIG. 2). Segmented in three branches, the holder 12 defines a pair of open cutout 13, 14 formed in the lower part of the open tube. Preferably spaced apart from each other about 18 inches, the cutout 13, 14 are each about 6 inches wide and 8 inches deep.

Tabs 15, 16 which are rigidly attached to the holder 12 press against the weight support columns 22, 23 to prevent rotation of the attachment 10 when it is in use (FIGS. 1–3). Each tab 15, 16 is preferably affixed to the weight support column 22, 23 by a C-clamp (not shown) or the like. The tabs 15, 16 stabilize the apparatus 10, making it a stable non-swinging platform from which to remove and on which to replace individual dumbbells 21.

Either one or two dumbbells 21 can be used simultaneously on the attachment 10. Each dumbbell 21 is placed thereon so that the cross bar of the dumbbell itself is located directly above one of the hand holds 13, 14. During exercise, an athlete sitting or lying on the bench 24 reaches through the appropriate cutout 13, 14 and lifts the dumbbell 21 off of the holder 12. At the completion of his exercise routine, the athlete, inserting his hand through an unused cutout 13, 14, then returns each dumbbell 21 to the holder 12.

The height of the apparatus 10 can be altered by making adjustments such as are commonly performed on barbell support columns 22, 23.

It is claimed:

1. A support for a dumbbell having a pair of weights, the support being adapted for use with a weight lifting bench having two vertically-disposed columns on which a barbell can be supported with its cross bar in a horizontally-disposed position, comprising:

(a) an elongated holder defining at least three branches which are spaced apart longitudinally from each other, contiguous pairs of branches being separated from each other by a distance which is shorter than the dumbbell in length; and (b) means for suspending the holder from the cross bar and between the two vertically-disposed columns, the holder and the suspending means defining a structure which, in transverse cross-section, has first and second portions disposed along two generally semicircular curves of diverse radii of curvature, the first portion having a substantially smaller radius of curvature than the second portion; an elongated hook slideably receivable by the cross bar defining the first portion, the holder defining the second portion, each branch forming an upwardly concave surface when the holder is suspended from the cross bar, so that the weights of the dumbbell can rest on each contiguous pair of branches.

2. The apparatus according to claim 1 which further comprises means protruding longitudinally from distal edges of the two branches disposed outermost within the holder for preventing the holder from rotating about the cross bar.

3. The apparatus according to claim 1 which further comprises each of the branches disposed outermost within the holder having at least one tab rigidly attached to the branch and extending longitudinally therefrom, the tab being disposed proximate with points situated lowermost on the branch and contacting one of the vertically-disposed columns when the holder is suspended therebetween.

4. A support for a dumbbell, the dumbbell having a pair of weights, each weight having a generally circular outer periphery, the support being adapted for use with an exercise weight lifting bench having a pair of vertical tubular members between which the bench is disposed, each of the tubular members having means for cradling a cross bar of a barbell, the barbell, when supported by the tubular members, having its cross bar disposed horizontally above said weight bench, comprising:

(a) a holder which defines an elongated open tubular cavity and a pair of cutouts which are spaced apart longitudinally, each cutout having a width which is similar to but shorter in length than the dumbbell, the cavity having a radius of curvature larger the outer radius of curvature of each of the dumbbell weights;

(b) means for hooking the holder onto the cross bar of the barbell when the barbell is supported by the columns, portions of each cutout being disposed proximate with points situated lowermost on the holder when the holder is suspended from the cross bar; and (c) means for preventing the holder from rotating about the cross bar when the support is being used.

5. The support according to claim 4 wherein the holder further defines at least one hand hold, the hand hold being shorter in width than the dumbbell in length.

* * * * *